US009894965B2

(12) United States Patent
Edmonston

(10) Patent No.: US 9,894,965 B2
(45) Date of Patent: Feb. 20, 2018

(54) TOOLERY

(71) Applicant: Rebecca Edmonston, New York, NY (US)

(72) Inventor: Rebecca Edmonston, New York, NY (US)

( * ) Notice: Subject to any disclaimer, the term of this patent is extended or adjusted under 35 U.S.C. 154(b) by 146 days.

(21) Appl. No.: 14/605,491

(22) Filed: Jan. 26, 2015

(65) Prior Publication Data

US 2015/0282574 A1 Oct. 8, 2015

Related U.S. Application Data

(60) Provisional application No. 61/932,531, filed on Jan. 28, 2014.

(51) Int. Cl.

| | |
|---|---|
| ***A44C 13/00*** | (2006.01) |
| ***A44C 15/00*** | (2006.01) |
| ***A44C 27/00*** | (2006.01) |
| *A45F 5/00* | (2006.01) |
| *A44C 25/00* | (2006.01) |

(52) U.S. Cl.

CPC ..... *A44C 15/005* (2013.01); *A44C 27/00* (2013.01); *A44C 25/001* (2013.01); *A45F 5/00* (2013.01); *A45F 2200/0541* (2013.01); *Y10T 29/4959* (2015.01)

(58) Field of Classification Search

CPC ... A44C 25/001; A44C 25/007; A44C 15/005; A45F 2200/0541

USPC ..... 63/23, 40, 1.11

See application file for complete search history.

(56) References Cited

U.S. PATENT DOCUMENTS

| | | | | | |
|---|---|---|---|---|---|
| 1,556,106 | A * | 10/1925 | Hamilton | A44C 15/0055 | 63/1.11 |
| 2,224,721 | A * | 12/1940 | Chernow | A44B 15/00 | 59/80 |
| 4,718,252 | A * | 1/1988 | Fossas | A44C 15/005 | 63/3 |
| 5,279,132 | A * | 1/1994 | Swaim | A44C 15/00 | 63/1.18 |
| 6,138,356 | A * | 10/2000 | Hertelendy | A44C 15/00 | 29/896.41 |
| 7,322,214 | B2 * | 1/2008 | Ignatowski | A44C 15/001 | 351/52 |
| 7,513,129 | B1 * | 4/2009 | Mays | A44C 15/005 | 63/3.2 |

(Continued)

*Primary Examiner* — Joshua Kennedy

(57) ABSTRACT

A convertible tool-chain with a counterweight designed to hold and carry tools in various configurations for maximum efficacy and comfort. Example configurations include but are not limited to: a tool-belt chain or a utility necklace with arrangements for receiving tools on the front, and a pendant or weight arranged on the rear to counterbalancing the weight tools on the front. In a second embodiment, the necklace is a decorative jewelry item, with an accessory pendant affixed to the back to counterbalance the weight of the decorative features on the front. A set of interchangeable counterweights may be provided with the necklace, possibly in different weights, for being attached to selected position (s) for counterbalancing loads in various positions. In addition, a method includes steps of selecting and positioning counterweight(s) on the rear of a necklace with weights and positions for counterbalancing load(s) on the front.

10 Claims, 8 Drawing Sheets

(56) References Cited

U.S. PATENT DOCUMENTS

| | | | | |
|---|---|---|---|---|
| 7,552,600 | B2 * | 6/2009 | Fields | A44C 15/005 63/3 |
| 8,763,357 | B1 * | 7/2014 | Arnone | A44C 25/007 59/35.1 |
| 2002/0078707 | A1 * | 6/2002 | Walker | A44C 5/209 63/3.2 |
| 2004/0200236 | A1 * | 10/2004 | Emberson | A44C 15/00 63/23 |
| 2008/0256796 | A1 * | 10/2008 | Fix | A44C 15/005 29/896.41 |
| 2012/0324946 | A1 * | 12/2012 | Latouf | A44C 15/005 63/1.13 |
| 2015/0027166 | A1 * | 1/2015 | Mace | A44C 15/005 63/3.1 |
| 2016/0128418 | A1 * | 5/2016 | Steele | A42B 7/00 63/1.11 |

* cited by examiner

TOOLERY

CROSS-REFERENCE TO RELATED APPLICATION

The present non-provisional patent application claims the benefit of priority from U.S. Provisional Patent Application No. 61/932,531, filed Jan. 28, 2014, the entire contents of which are incorporated herein by reference.

SUMMARY

The invention relates to a necklace with at least one rear pendant provided to counterbalance the weight on the front of the necklace in order to avoid stress on the back of the wearer's neck.

In one embodiment, the necklace is a utility necklace with arrangements for receiving useful items conveniently accessible on the front of the necklace, and a pendant on the rear of the necklace for counterbalancing the weight of the useful items on the front.

In a second embodiment, the necklace is a decorative jewelry item, with an accessory pendant affixed to the back to counterbalance the weight of the decorative features on the front.

In either case, the necklace is sized to suit the head size of the wearer.

The invention is not limited to the described examples. In particular, the term "pendant" should be interpreted as including any object suitable for serving as a counterweight on a necklace.

As explained herein, the invention relates to a combination of a necklace and a rear counterweight. The necklace may be a piece of jewelry, or designed more for utility than for fashion. The rear counterweight may be permanently attached, or removable.

A set of interchangeable counterweights may be provided with the necklace, possibly in different weights, for being attached to selected position(s) on the necklace for counterbalancing various loads in various positions.

The invention also extends to a set of counterweights, not associated with a specific necklace, from which the user may select at least one suitable counterweight for use with a particular utility-type or decorative necklace.

The invention further relates to a method, including steps of selecting and positioning one or more counterweights on the rear of a necklace for counterbalancing the load on the front.

DETAILED DESCRIPTION

First Embodiment

Examples of the first embodiment are seen in FIGS. 1-6.

Figure 1:
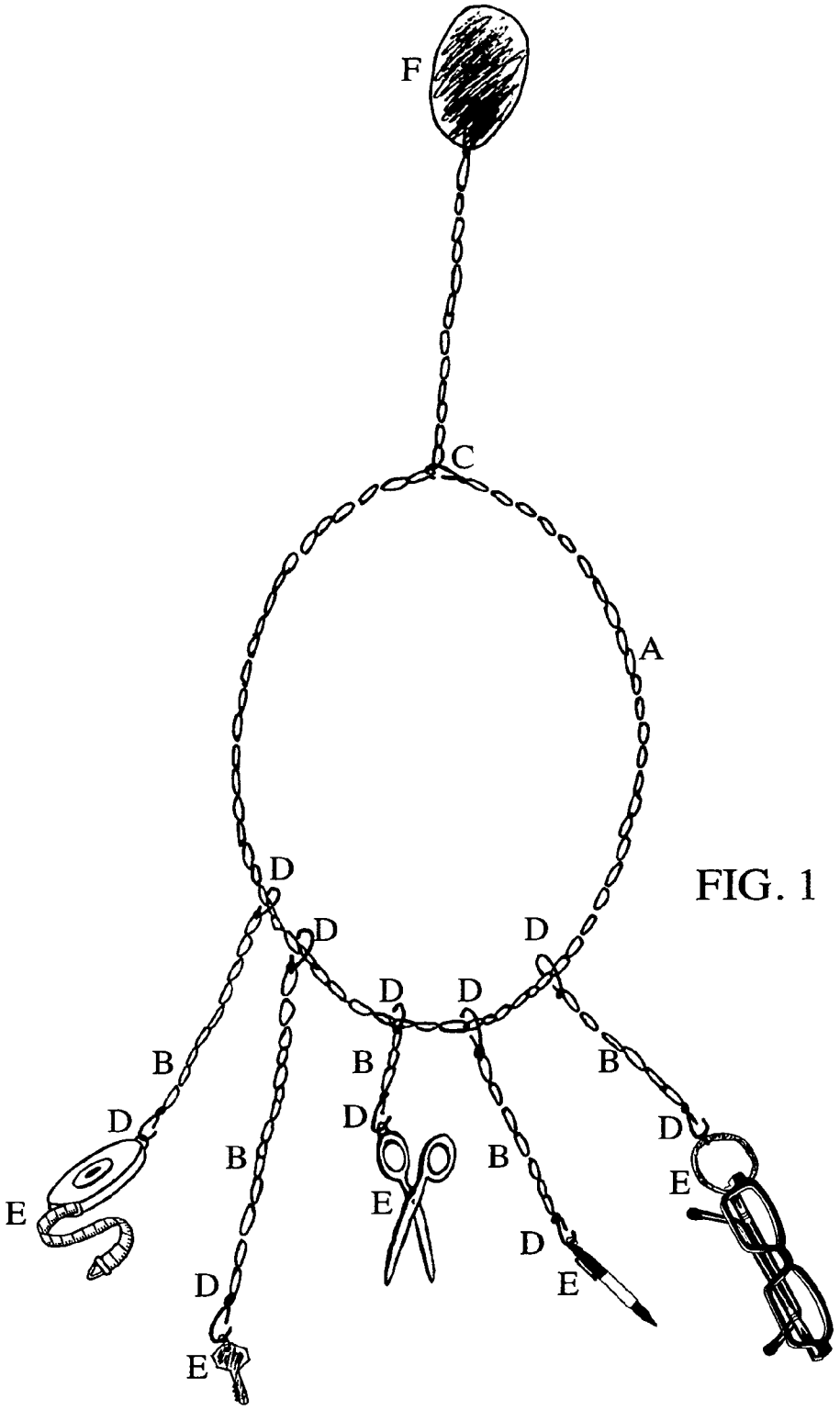
FIGS. 1-6 show a utility necklace according to a first embodiment of the invention.
Figure 2:
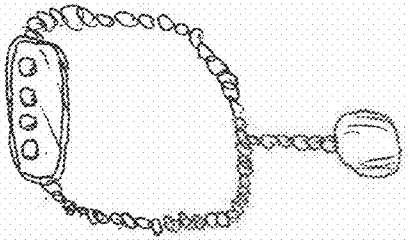

The necklace of FIG. 1 has chains on the front (toward the bottom of the figure) for holding various items in convenient position for use, and a rear pendant with a sufficient weight for counterbalancing the weight of the items on the front.

Additional details are seen in FIGS. 3-6. In this example, one of the chains supports a ring for holding a pair of eyeglasses or another item that can be hung on such a ring, one chain supports a pair of folding scissors, and one holds a key. The chains (or the necklace itself) are advantageously long enough so that the hanging item (for example the key) is in position for use without being removed from the necklace. Also advantageously, the items can be provided with individual clasps or hooks for being removed from the necklace for use, and then easily returned to the necklace.

As an alternative or in addition to the individual chains, a plate or another type of large-scale support with appropriate apertures or fastening means may be provided for receiving the useful items on the front of the necklace. See FIG. 2. In this example, in addition to the rear pendant, the necklace supports a decorative plate with four holes for receiving the items, for example via hooks or clasps attached to the items.

Of course, the rear counterweight need not be a pendant, but could take another form, such as an object incorporated into the rear part of the necklace, or a heavier material forming a rear part of the necklace.

Furthermore, the invention may include a set of rear pendants having various weights, rather than a single pendant as shown. The user can then choose the rear pendant having the best weight for counterbalancing the front load. For example, on a day when the user needs to carry a heavy set of keys on the front, a heavier rear pendant can be chosen as the counterbalance.

Moreover, the rear pendant can be placed in an optimized position for performing its function. In the last example, if the heavy keys are to be secured to the left-front side of the necklace, the user can secure a pendant of a corresponding weight to the right-rear side of the necklace for best counterbalancing of the front weight. Moreover, in that case a lighter pendant could be placed on the left-rear side of the necklace for a more balanced load all around the necklace.

In each of these examples, one or more counterweights are placed on the rear side of the necklace. The counterweight(s) may be permanently secured to one point on the necklace, or removable and interchangeable at selected positions on the necklace for optimizing the counterbalancing of the front load.

Figure 3:
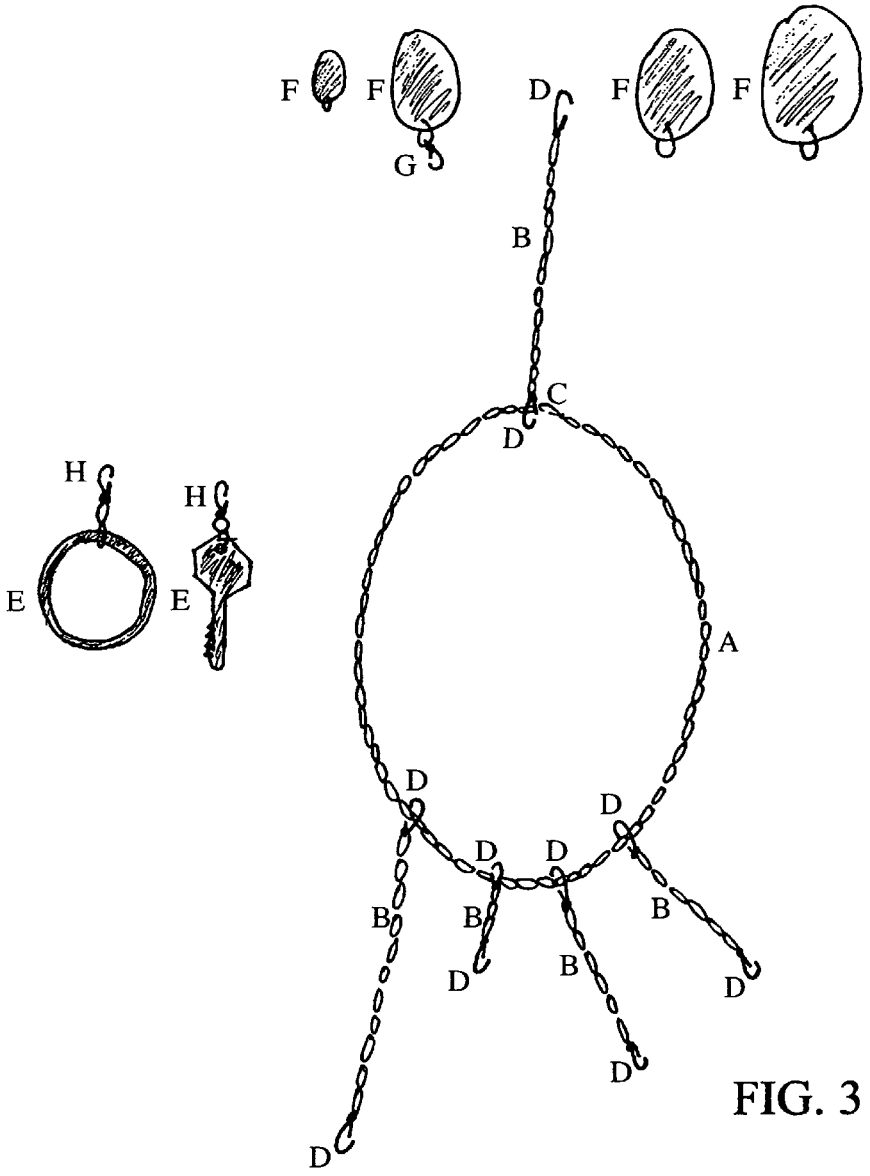
Figure 4:
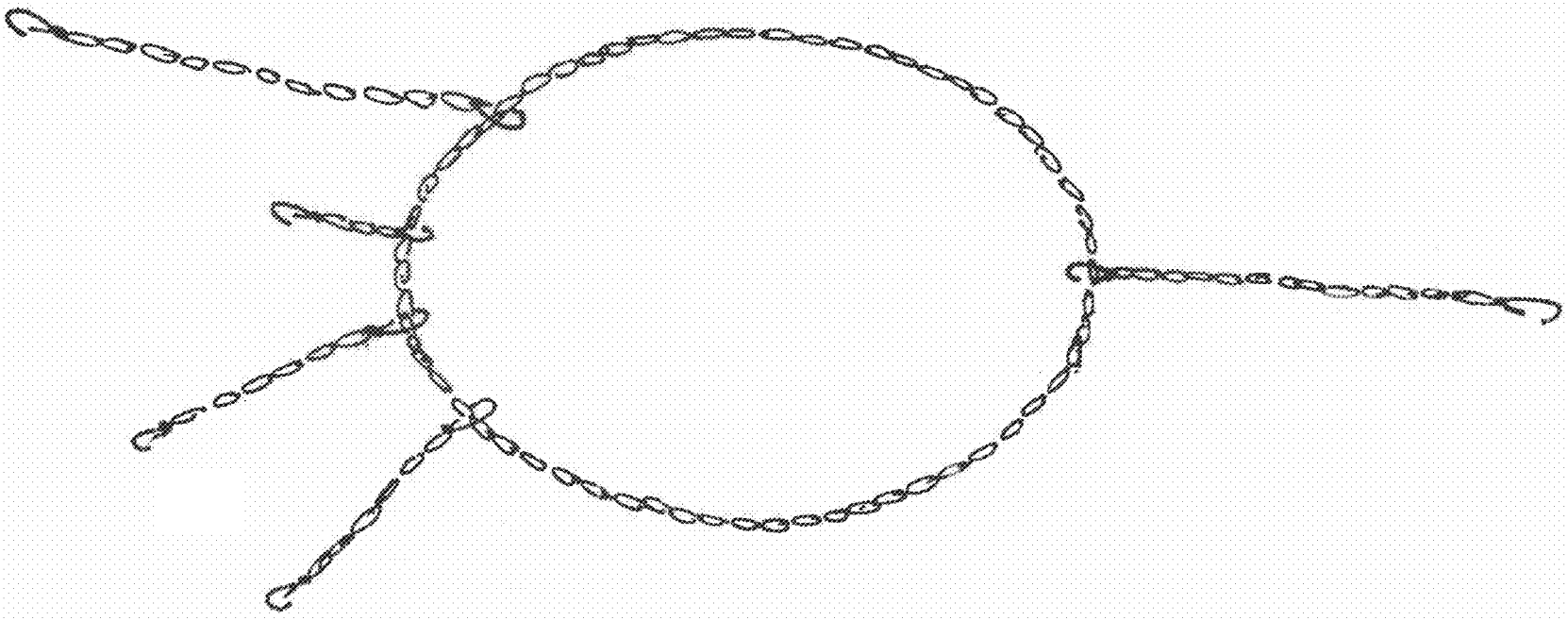
Figure 5:
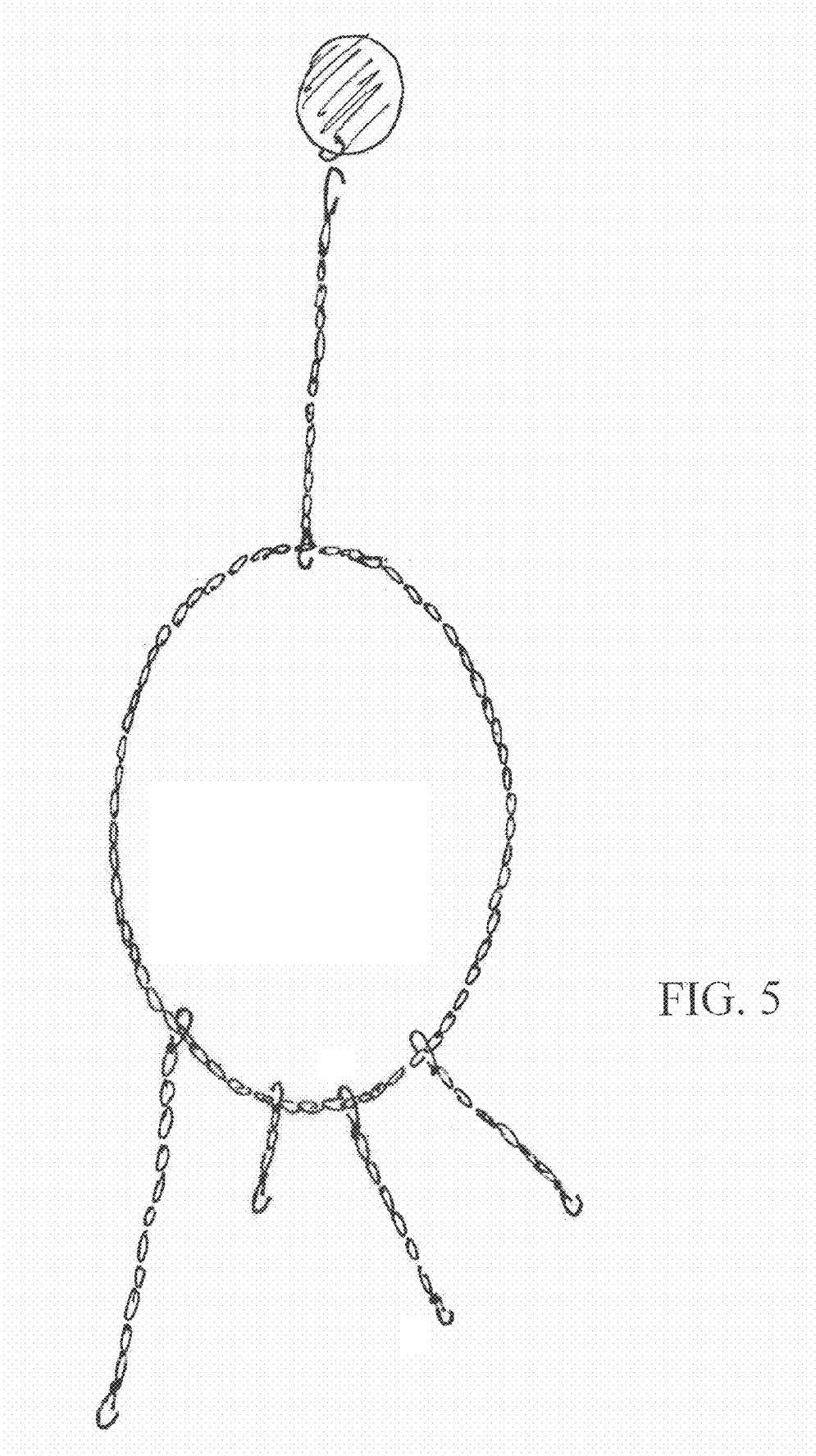
Figure 6:
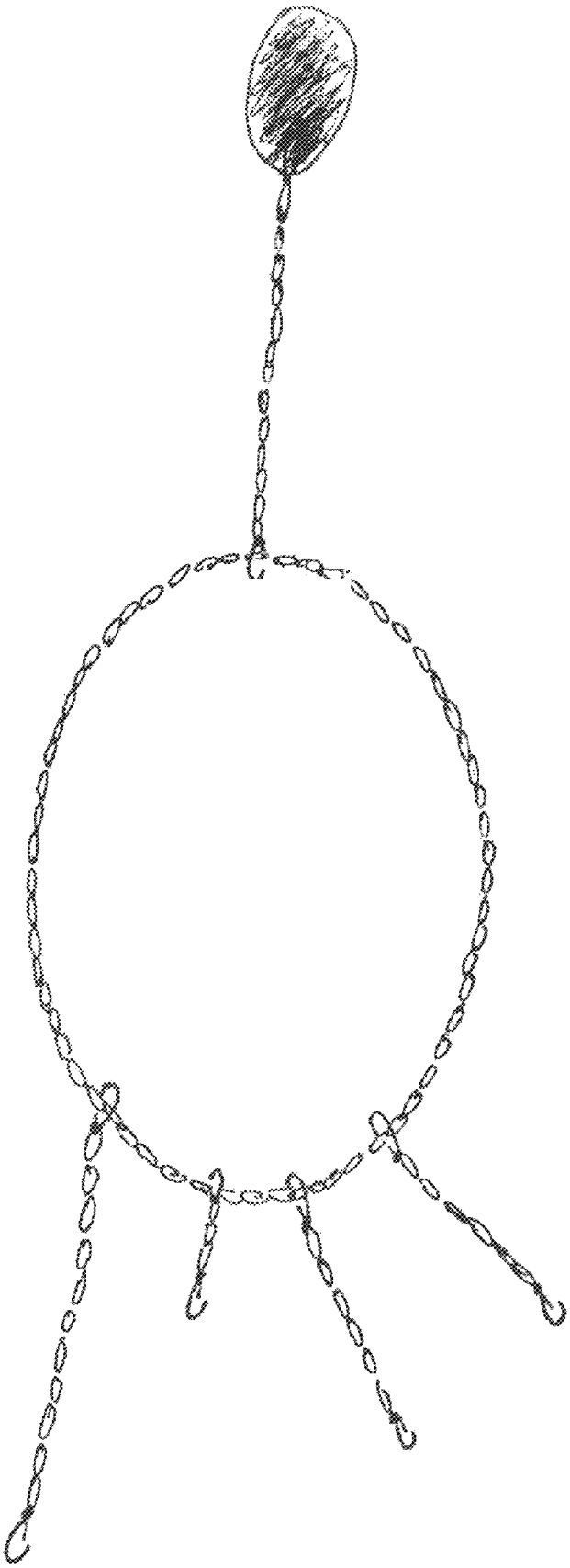

Referring specifically to FIG. 3, there are seen varying sizes and weights of counterbalancing pendant which can be attached to the back of the necklace. Chains may be provided for the attachment of the counterweights. Clasps may be provided on the chains or on the counterweights. The chains can vary in length. Clasps may be provided for removably attaching the counterweights to the chains.

As shown, an example of a utility item may be a key, and/or a ring for holding eyeglasses. These items may or may not have clasps attached.

Clasps may be removed or added to the utility chains as needed. For example, a clasp may be provided on a chain for an individual utility item if the item does not have a clasp. On the other hand, if a utility item does have a clasp, a clasp may be removed from a corresponding chain as necessary.

Second Embodiment

The second embodiment relates to providing one or more counterweight pendants, possibly a set of pendants in various weights, for attaching to the back of a decorative (jewelry-type) necklace for counterbalancing the front load and reducing the stress on the back of the user's neck. Any suitable type of hook or clasp may be provided for attaching the pendant to the back of the necklace.

Figure 7:
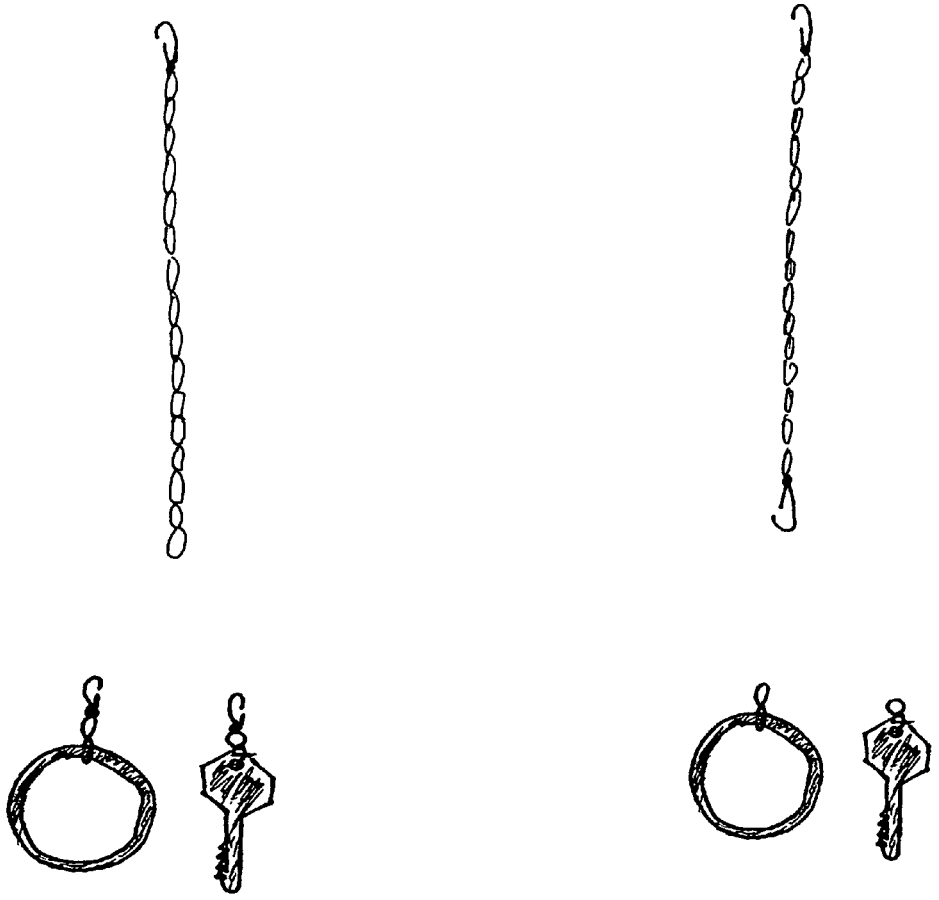
FIGS. 7-8 show a decorative jewelry-type necklace according to a second embodiment of the invention.
Figure 8:
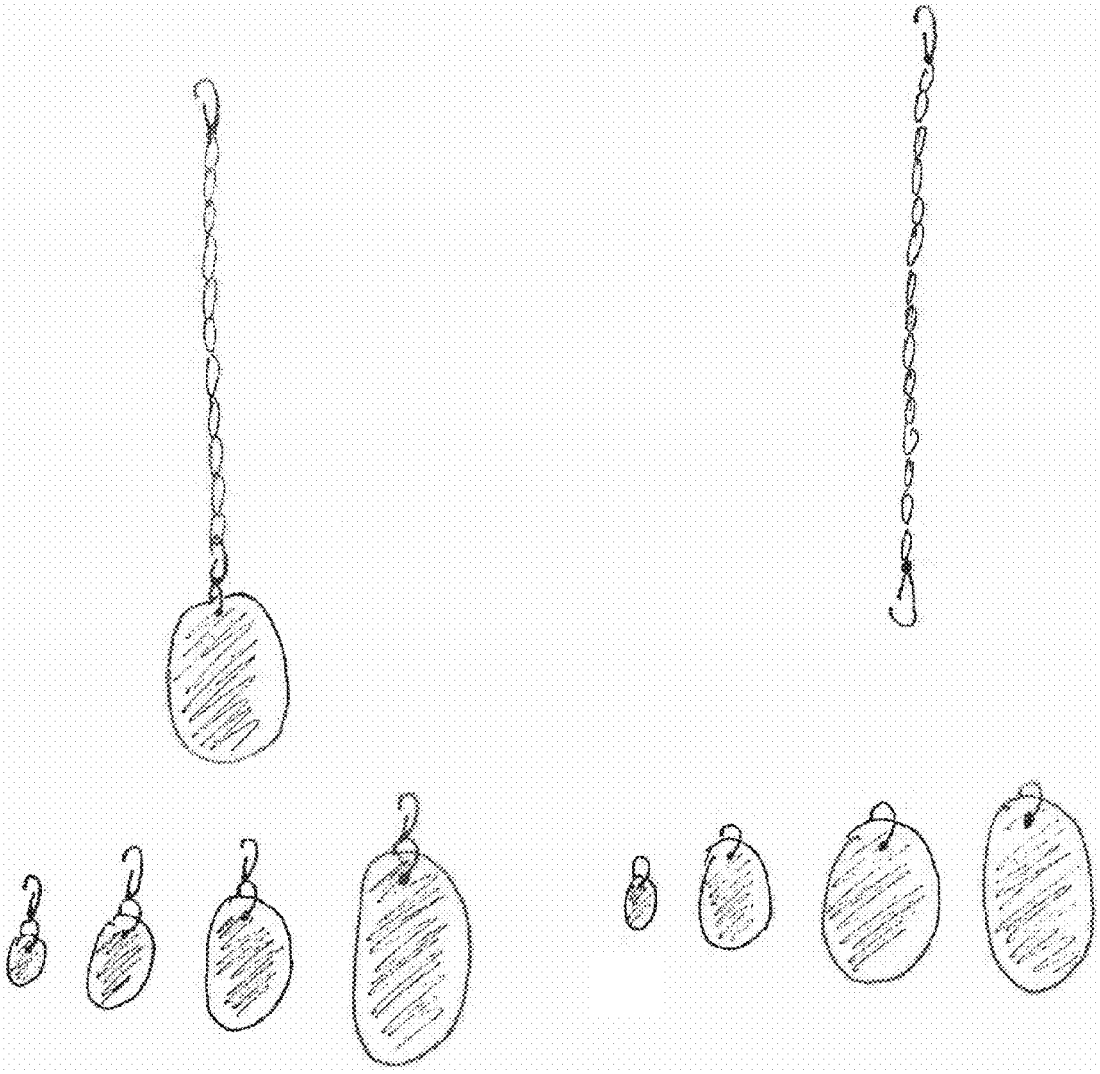

An example is seen in FIGS. 7 and 8. As described above in connection with the first embodiment, one or more pendants are selected from the set of pendants in the second embodiment for counterbalancing the load(s) on the front of the necklace.

Referring specifically to FIG. 7, separate counterweight (s) may be provided for the back of any necklace to provide a counterbalancing weight for a load on the front of the necklace. Preferably the counterweight is attached to the back of a necklace with chain. Counterweight pendants with various sizes and weights may be provided, with or without clasps. Pendants and/or chains can have clasps to attach varying sizes and weights of counterbalancing pendants to the necklace.

In each of these embodiments, the weight relationship between the front and back loads can be adjusted for greatest comfort and utility. If the rear load is equal to the front load, the necklace may not hang properly for cosmetic purposes. On the other hand, equal front and rear loads may provide optimal counterweighting and greatest comfort. With the pendants or other counterweight objects being detachable and interchangeable, the user can select an optimal counterweight and optimal attachment point for satisfying both of these needs.

As explained herein, the invention relates to a combination of a necklace and a rear counterweight. The necklace may be a piece of jewelry, or designed more for utility than for fashion. The rear counterweight may be permanently attached, or removable.

A set of interchangeable counterweights may be provided with the necklace, possibly in different weights, for being attached to selected position(s) on the necklace for counterbalancing various loads in various positions.

The invention also extends to a set of counterweights, not associated with a specific necklace, from which the user may select the proper counterweight for use with a particular utility-type or decorative necklace.

The invention further relates to a method, including steps of selecting and positioning one or more counterweights on the rear of a necklace for counterbalancing the load on the front.

Although embodiments and examples of the invention have been described, the invention is not limited to the present disclosure, but extends rather to all modifications and variations within the reasonable scope of the disclosure that might occur to those having ordinary skill in the pertinent field.

What is claimed is:

1. A utilitarian convertible tool-chain designed to be worn around different parts of a user's body to function as a means to hold and carry useful items or tools, said convertible tool-chain comprising:

at least one utility item;

a base chain comprising a plurality of links and having an end clasp on one or both ends thereof;

at least one utility chain, each utility chain having a first clasp at a first end thereof which removably secures each utility chain to the base chain at any point along a length of the base chain;

a second clasp located either at a second end of said at least one utility chain or on a corresponding one of said at least one utility item to removably secure the at least one utility item to said at least one utility-chain; and at least one counterweight permanently or removably attached to either a counterweight chain or directly to the base chain and having an attachment mechanism to facilitate attachment of said at least one counterweight to one of said links at any point along a length of the base chain to counterbalance a weight of said at least one utility chain and corresponding utility item;

wherein said convertible tool-chain is transformative in that the base chain and/or each utility chain can be worn, together and/or separately, around different parts of the user's body to be configured differently to conform to where/how it is worn by the user and are advantageously long enough so that the a least one utility item is in position for use without being removed from the base chain.

2. The convertible tool-chain of claim 1, wherein said base-chain can be attached to itself by connecting the end-clasp of one end of the base-chain to a link or to said other end-clasp of said base-chain to secure it around a user's body part;

wherein the size of the base-chain circumference can be varied depending on which link the end-clasp is attached to on the base-chain such that the base-chain can be made to fit around different body parts and/or around different size users.

3. The tool-chain of claim 2, further comprising a plurality of utility-chains and corresponding utility items arranged on the tool-chain;

wherein said at least one counterweight that acts to counterbalance respective weights of said plurality of utility-chains and corresponding utility items arranged on the base-chain of said tool-chain, said at least one counterweight being comprised of:

a pendant, excess chain created from attaching the base-chain to itself on a link of the base-chain other than the end link, and/or a weighted portion of said rear side of said base-chain.

4. The tool-chain of claim 2, wherein said attachment mechanism comprises one of:

a clasp on the at least one counterweight and/or on a link of the base-chain, a clasp on said counterweight chain that removably secures the utility-chain to the base-chain and/or the counterweight to the utility-chain, or a clasp on said counterweight chain with the at least one counterweight permanently attached on one end and that removably secures the at least one counterweight chain to the base-chain.

5. The tool-chain of claim 1, wherein said at least one counterweight is permanently attached to the tool-chain by:

a link of chain and/or a jump-ring that connects the at least one counterweight to an end of the base-chain and/or to the end of any excess chain created by attaching the base-chain around the user's neck to wear it as a tool-necklace.

6. The tool-chain of claim 1, wherein said chain can be adjusted by:

varying the length of the counterweight chain to adjust the counterbalancing function of the at least one counterweight, varying an amount or weight of the at least one counterweight;

arranging said at least one counterweight at a different point on the tool-chain to counterbalance a respective weight of said at least one utility item on an opposite point of the tool-chain, and/or, arranging a plurality of said counterweights with each attached at a different point on the tool-chain to counterbalance the respective weight of said at least one utility item.

7. The tool-chain of claim 2, wherein the end-clasp of the base-chain is fastened to itself and is configured to be fit around a user's waist or hips to be used a tool-chain belt.

8. The tool-chain of claim 1, wherein one or more of said at least one utility-chain and corresponding utility item is removable from the base-chain and configured as a bracelet by:

securing at least one utility-chain to itself by attaching one or more of said utility chain end-clasps to a link in said utility-chain to fasten it around a wrist, securing a plurality of said at least one utility-chain to each other to create a longer chain, with corresponding utility items, which winds around a wrist more than once and attaches to itself by securing one or more end-clasps to a link which secures said utility-chains around a wrist to be fashioned as a multi-tool holding bracelet having a plurality of utility items are secured for use near the hands of the user.

9. The tool-chain of claim 1, wherein one or more of said at least one utility-chain and corresponding utility item is removable from the base-chain and configured as an anklet by:

securing said at least one utility-chain to itself, by attaching one or more of said utility-chain end-clasps to a link in said utility-chain to fashion it around the ankle of the user, or securing a plurality of said at least one utility-chain to each other to create a longer chain, with corresponding utility items, which winds around the ankle more than once to attach to itself by attaching one or more end-clasp to a link to secure multiple utility-chains around the ankle to be fashioned as a multi-tool holding anklet.

10. The tool-chain of claim 1, further comprising a support body secured to the base-chain and having apertures and/or fasteners for having said at least one utility item secured thereto.

* * * * *